US006889982B1

(12) United States Patent
Gove

(10) Patent No.: US 6,889,982 B1
(45) Date of Patent: May 10, 2005

(54) INDOOR/OUTDOOR GAME

(75) Inventor: Scott Gove, Oakdale, MN (US)

(73) Assignee: Bolo USA, Wabasso, MN (US)

( * ) Notice: Subject to any disclaimer, the term of this patent is extended or adjusted under 35 U.S.C. 154(b) by 0 days.

(21) Appl. No.: 10/190,120

(22) Filed: Jul. 3, 2002

Related U.S. Application Data

(60) Provisional application No. 60/303,268, filed on Jul. 5, 2001.

(51) Int. Cl.[7] ..... A63B 67/00
(52) U.S. Cl. ..... 273/343; 273/400; 473/575
(58) Field of Search ..... 273/398–402, 273/407, 172, 195–197, 454–456, 446, 476–478, 273/459, 343, 404–406; 244/161; 473/575

(56) References Cited

U.S. PATENT DOCUMENTS

| | | | | | |
|---|---|---|---|---|---|
| 1,677,442 | A * | 7/1928 | Hall | 473/190 |
| 2,123,195 | A * | 7/1938 | Middleton | 473/137 |
| 2,899,208 | A * | 8/1959 | Wallstiner | 473/194 |
| 3,575,415 | A * | 4/1971 | Fulp et al. | 273/400 |
| 4,395,042 | A * | 7/1983 | Boswell | 473/195 |
| 5,269,527 | A * | 12/1993 | Noval | 473/197 |
| 5,279,482 | A * | 1/1994 | Dzenitis et al. | 244/161 |
| 5,575,480 | A * | 11/1996 | Wehr | 273/402 |
| 5,785,618 | A * | 7/1998 | Coleman et al. | 473/576 |
| 5,803,841 | A * | 9/1998 | Daskoski | 473/454 |
| 5,941,529 | A * | 8/1999 | Kinsey | 273/401 |
| 6,135,456 | A * | 10/2000 | Cooper | 273/371 |
| 6,308,956 | B1 * | 10/2001 | Reid | 273/343 |
| 2002/0084588 | A1 * | 7/2002 | Lynch | 273/343 |

* cited by examiner

*Primary Examiner*—Mark S. Graham
(74) *Attorney, Agent, or Firm*—Larkin Hoffman Daly & Lindgren Ltd.; Frederick W. Niebuhr

(57) ABSTRACT

A gaming apparatus is provided, including at least one freestanding, upright first target having three target zones spaced apart from each other, each having a different sized forward facing opening and at least one projectile. The first target member includes first and second vertical support members and at least three pairs of crossbeams extending therebetween. The apparatus includes a second target substantially identical to the first target and spaced from the first target on a playing surface. In one embodiment, a method of playing an aerial projectile game includes separating a first target and a second target, directing a projectile toward one of the targets from a station proximate the other target, and awarding points for each projectile that lodges in a scoring zone of the target. A method of assembly includes coupling a plurality of tubular segments into a ladder-shaped configuration, and coupling the ladder configuration to a base member in an upright configuration with respect to a playing surface.

34 Claims, 11 Drawing Sheets

24
24
12
16
16
80
17
82
16'
16'
84
17
86
16"
16"
19
12
26
19
26

12
24
24
16
16
180
117
116
16'
16'
182
117
16"
16"
19
12
26
19
26

INDOOR/OUTDOOR GAME

STATEMENT OF INCORPORATION BY REFERENCE

This application claims benefit of Provisional Application No. 60/303,268 entitled "Projectile Game" filed Jul. 5, 2001, which is incorporated herein by reference as if fully set forth herein.

FIELD OF THE INVENTION

The present invention relates to the field of recreational games and games of skill, and more particularly to a games wherein a player directs a gaming projectile toward a target.

BACKGROUND

Recreational games and games of skill wherein players hurl a projectile toward a target, zone, or toward another player have a long history. Examples of such games are set forth in U.S. Pat. No. 5,375,848 issued to Coleman Dec. 27, 1994; U.S. Pat. No. 3,717,348 issued to Bowers Feb. 20, 1973; U.S. Pat. No. 4,487,419 issued to Welborne Dec. 11, 1984 and U.S. Pat. No. 5,954,337 issued to Cunningham Sep. 21, 1999.

SUMMARY OF THE INVENTION

The present invention is directed to a game wherein a player directs (e.g., throws, slings, twirls, lobs, tosses, flings, or hurls) a gaming projectile toward a freestanding, upright target.

In one embodiment, a gaming apparatus is provided, including a set of freestanding, upright targets, at least one projectile and a compact carrying bag. A freestanding, upright first target is disposed substantially perpendicular to the horizontal plane of a playing surface. The first target has a set of three target zones (or scoring zones) spaced apart from each other, each having a different sized forward facing opening area. In one embodiment, the target zones have rectangular shaped openings. In one embodiment the first target includes first and second vertical support members and at least three pairs of crossbeams extending therebetween. In one embodiment, a second target substantially identical to the first target is placed on the playing surface, spaced a predetermined distance from the first target.

One embodiment of the present invention is directed to a method of playing a game with a single target, with one or more players directing a projectile toward the target. Alternatively, more than one target may be used. In one embodiment, a method of playing an aerial projectile game includes separating a first target and a second target, hurling a projectile toward one of the targets from a station proximate the other target, and awarding points for each projectile that lodges in a target or scoring zone of the target. The game may be played by individuals or teams, and may include alternative scoring systems.

Another embodiment is a method of fabricating a game. Two freestanding, upright targets are readily assembled and disassembled, using color-coded parts. Each target has three target or scoring zones. Each scoring zone has a horizontal upper rim and a horizontal lower rim coupled to each target and vertically spaced to define a target opening. A piece of material such as cloth, netting or the like is coupled to the upper and lower rims. The piece of material is longer than the vertical distance between the upper and lower rims, and forms a pouch just below the lower rim. A visible portion of each target preferably displays a number representing the number of points awarded to a player for successfully lodging a projectile in that particular scoring zone. Each target preferably has a different size target opening with the smallest target opening corresponding to a higher number of points and the largest target opening displaying a lower number of points. Preferably the smallest target opening corresponds to the uppermost scoring zone and the largest target opening corresponds to the bottom scoring zone.

Certain embodiments of the present invention are set forth in the accompanying drawings in which like elements are referred to be common reference numerals. These drawings are not drawn to scale and are intended to illustrate certain embodiments and aspects of the present invention in combination with the written disclosure hereof, including the Appendix. Those of skill in the art to which the present invention is directed will readily determine additional embodiments and modifications to the drawings and each such embodiment and modification is intended to be covered hereby.

DETAILED DESCRIPTION OF PREFERRED EMBODIMENTS

Figure 1:
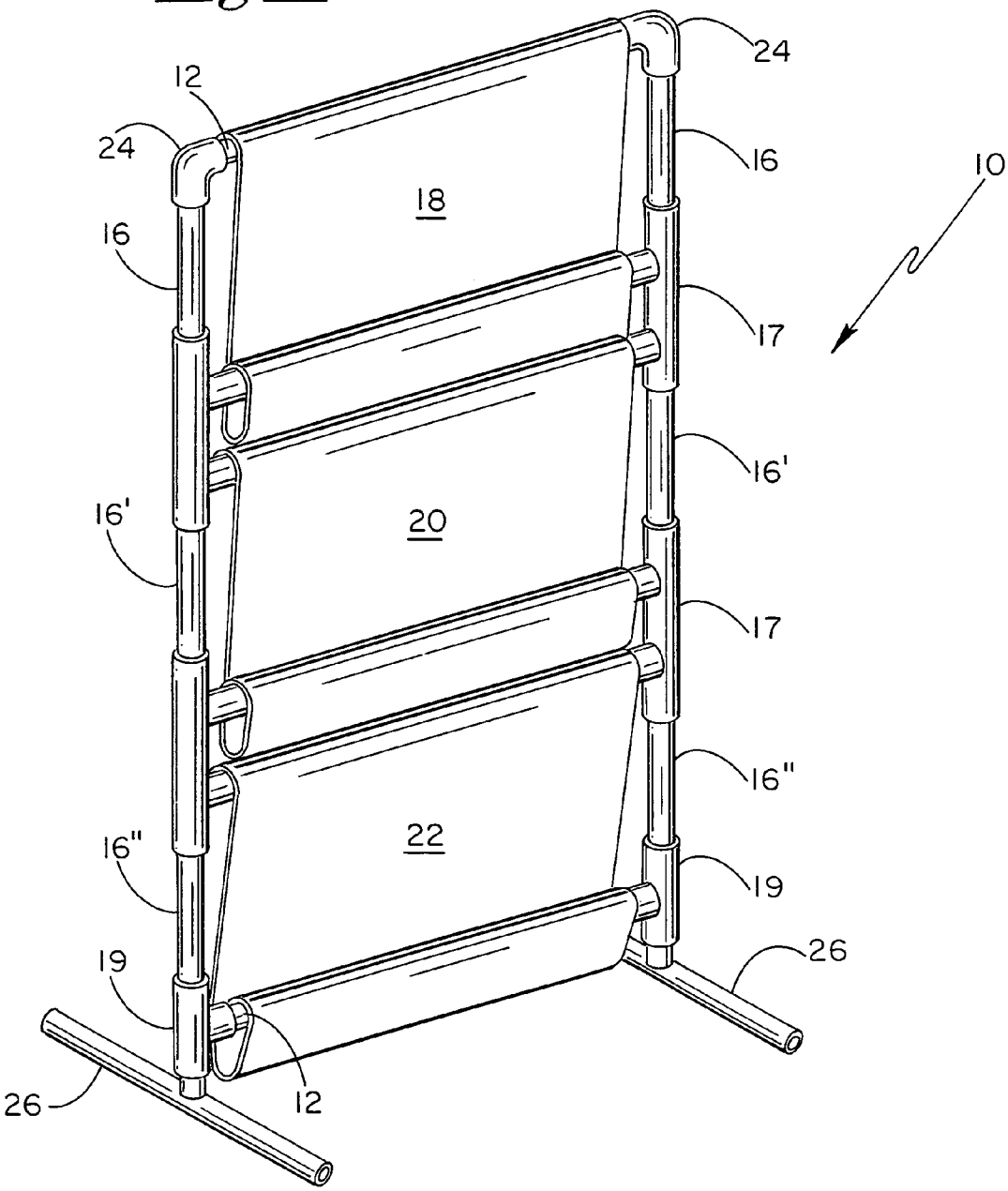
FIG. 1 is a perspective view of an embodiment of one freestanding, upright target for use with and according to the present invention.

The present invention relates to the field of recreational games and games of skill. In particular, the present invention is directed to a game wherein a player throws, slings, twirls, lobs, tosses, flings, or hurls a gaming projectile toward a freestanding, upright target. The upright target has multiple open-sided scoring zones having different sized forward facing, rectangular openings. Points are awarded when a projectile successfully passes through the target opening and lodges in one of the scoring zones. A specific number of points is awarded to a player who successfully lodges a projectile in one of the scoring zones, each having a different point value associated therewith. The present invention concerns a pair of portable freestanding, upright targets, a set of projectiles, a compact carrying bag and methods of fabricating and playing the indoor/outdoor game.

Two freestanding, upright targets for the projectile game are readily assembled and disassembled with parts thereof preferably color-coded. Each of the freestanding upright targets has three individual target zones. Each target zone has an upper and a lower horizontal rim element coupled to the freestanding upright support and vertically spaced apart to define a target opening. A piece of cloth, netting material or the like, longer than the spacing between the upper and lower rims, is coupled to the upper and lower rim. The material forms a pouch just below the lower rim. A visible portion of each target preferably displays a numerical value representing the number of points awarded to a player for successfully lodging a projectile in that particular target zone. Each target preferably has a different size target opening, with the smallest target opening corresponding to a highest number of points and the largest target opening displaying the lowest number of points. Preferably the smallest target opening corresponds to the top target zone and the largest target opening corresponds to the bottom target zone.

While the game may be played with a single target with one or more players directing a projectile toward the target, more than one target may be used. In one form of the present invention, a pair of targets is spaced apart based on the length of the stride of one of the players. Thus, the game is adaptable to the size or age of the players. The preferred spacing is ten (10) paces or steps of any given player.

Opposing teams or players use different colored sets of projectiles. Each projectile may comprise a single member (e.g. a tennis ball, a baseball, a beanbag, or other projectile), or a complex or multi-element member (e.g. a weighted member with vanes or a so-called wiffle ball, a blunt arrow, a set of bolo balls and the like). Each player stands next to a target and hurls the projectile at the opposing target with a goal of lodging the projectile in a target zone. Scores are awarded based on which target zone "captures" the projectile. According to one possible scoring scheme, a projectile captured in the material coupled to the top target zone counts as three points. Two points are awarded when a projectile is captured in the middle target zone, and one point is awarded when a projectile is captured in the bottom target zone. Other scoring schemes may be used.

The freestanding, upright target resembles a ladder having greater spacing between the bottom pair of horizontal rungs than the top pair of horizontal rungs. The rungs are spaced so that between each pair of rungs is a narrow non-scoring area. Depending on the size and shape of the projectile used to play the game, a player may dislodge a previously captured projectile by knocking it out of a target zone pouch. A projectile may be dislodged by either forcefully impacting the target zone material causing the material to temporarily tighten (and thus reduce the pouch) or by hitting a side of a projectile (through the material) while the projectile is lodged in a pouch. The latter technique requires precise aim since only a small portion of the pouch is reachable.

During play, a player may attempt to dislodge a projectile from a scoring zone. Depending on the scoring system, a player may desire to dislodge his or her own projectile or the projectile of an opponent. This is true when the scoring system requires an exact point total before declaring a winner. For example, if twenty-one points is the exact point total, a player having twenty points may might dislodge a projectile lodged in a two point target zone and attempt to win the game by subsequently lodging a projectile in the three point target zone.

The three target zones are preferably color-coded, each with a unique color. In one embodiment, the uppermost target zone is red, the middle target zone is white and the bottom target zone is blue. Furthermore, the vertical bars adjacent each target zone are similarly color-coded. Of course, these colors may be changed to any arbitrary color scheme. All the target zones and adjacent portions of the freestanding, upright target may all have the same color. Numerals or other scoring indicia may be provided on the material for each target zone and/or may be provided on the adjacent portions of the freestanding upright target structure.

A variety of scoring systems may be used in conjunction with the gaming apparatus of the present invention. In one scoring system, the first player (or team) to score exactly a pre-set number of points is declared the winner of a game. Preferably, the number of points to win a game is set at twenty-one. If a player exceeds the pre-set number of points the player (or team) must go back to the last score and the other player (or team) attempts to score the pre-set number of points and thus win the game. For each round of the game, all the projectiles remain in place until the round is over. If opposing players (or teams) lodge a projectile in the same target zone on the same round of play, a "wash" is declared and no points are awarded for that particular target zone (or target zones—if two or more are engaged by both teams). This provides for blocking maneuvers, which increases the competition and provides opportunities for advanced play between teams.

Another scoring system provides a means for single players to increase their skill and the coordination required to participate successfully in the game according to the present invention. In this scoring system, a predetermined number of projectiles (or "turns") comprise a single game. For example, ten attempts or five turns may comprise a full game sequence. At the end of the game sequence the total number of points awarded determine the winner.

The gaming apparatus, methods of fabricating the gaming apparatus and methods of playing the game are all described herein with reference to FIGS. 1 through 11. Referring now to FIG. 1, each freestanding, upright target member 10 is preferably readily assembled and disassembled and carried and stored as a compact package, such as a open-ended bag or satchel 90 or duffel bag 94 (see FIG. 5A-B). Bag 90 has a drawstring closure. Bag 94 has a zipper closure, a shoulder strap 98 and handles 100.

In one embodiment of the present invention (shown at FIG. 2A), each target member 10 comprises: two T-shaped coupling members 19, two L-shaped coupling members 24;

six straight frame segments 16 (preferably three pairs of color-coded members 16, 16' and 16" as described below), two dual crossbeam members 17, two single crossbeam members 12 and two base members 26 (same size as crossbeam member 12). The straight frame segments of each pair 16, 16' and 16" are the same length. Preferably, the three pairs 16, 16' and 16" of straight frame segments are of slightly different length so that when the target 10 is assembled, three different size target zones 18,20,22 are formed. The top target zone 18 is coupled to the upper single crossbar member 12 and the upper crossbeam 80 of the dual crossbeam member 17 leaving the lower crossbeam 82 (best seen at FIGS. 2A and 2B) of the upper dual crossbeam member 17 to couple to the middle target zone 20. The middle target zone 20 also is coupled to the upper crossbeam 84 (best seen at FIGS. 2A and 2B) of the second dual crossbeam member 17. Accordingly, the bottom target zone 22 couples to the lower crossbeam 86 (best seen at FIGS. 2A and 2B) of the second dual crossbeam member 17 and to the lower single crossbeam member 12. As best seen in FIG. 3, target zones 18, 20 and 22 are longer in the vertical direction than the vertical distance between their associated crossbar or crossbeam members, to provide respective pockets or pouches 18*a*, 20*a* and 22*a*. Each of the pockets is adapted to capture or retain projectiles thrown or otherwise directed against its associated target zone.

Figure 2A:
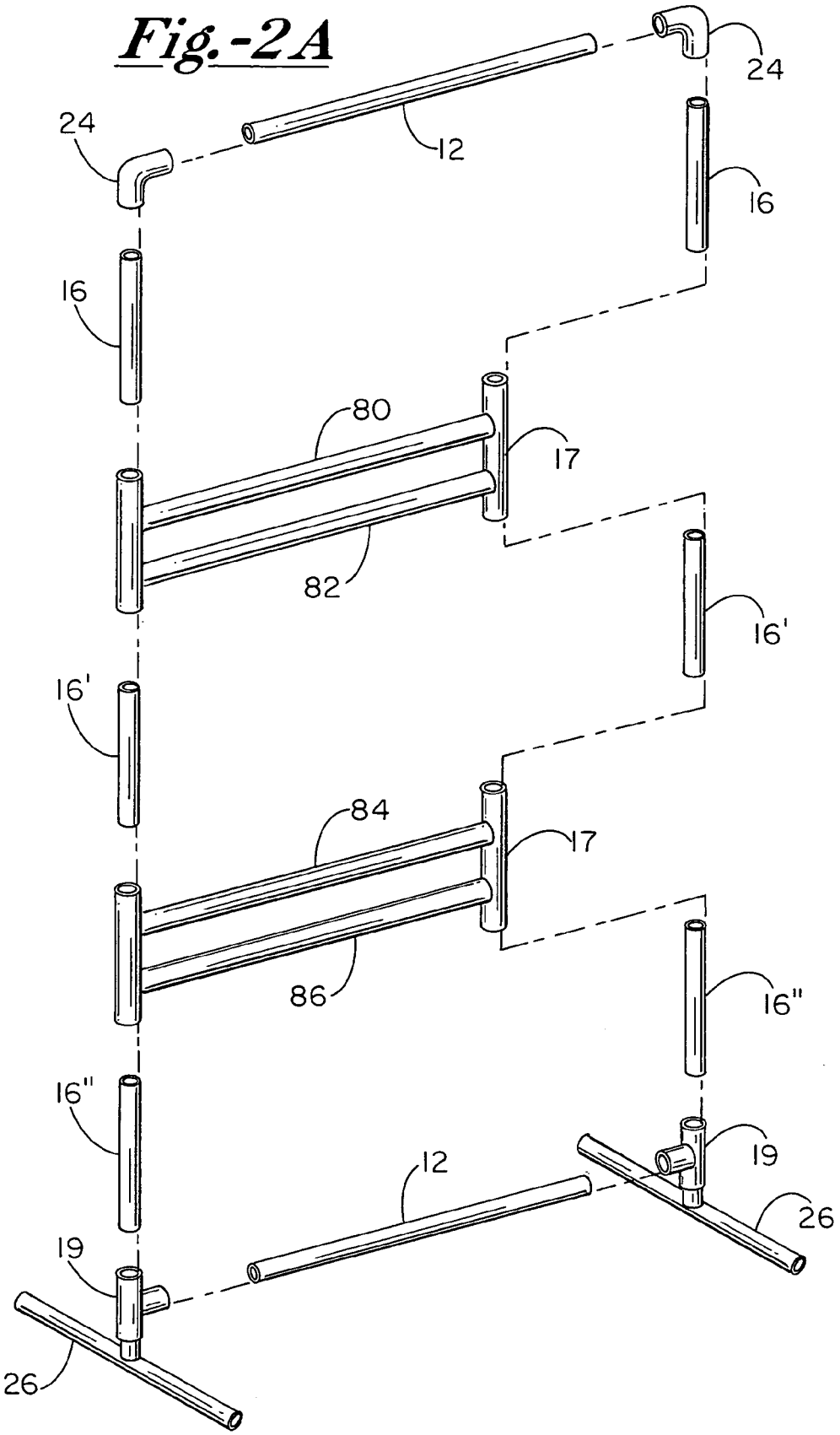
FIG. 2A is an exploded-parts view of the target as in FIG. 1 showing the individual components of the freestanding upright target.
Figure 2B:
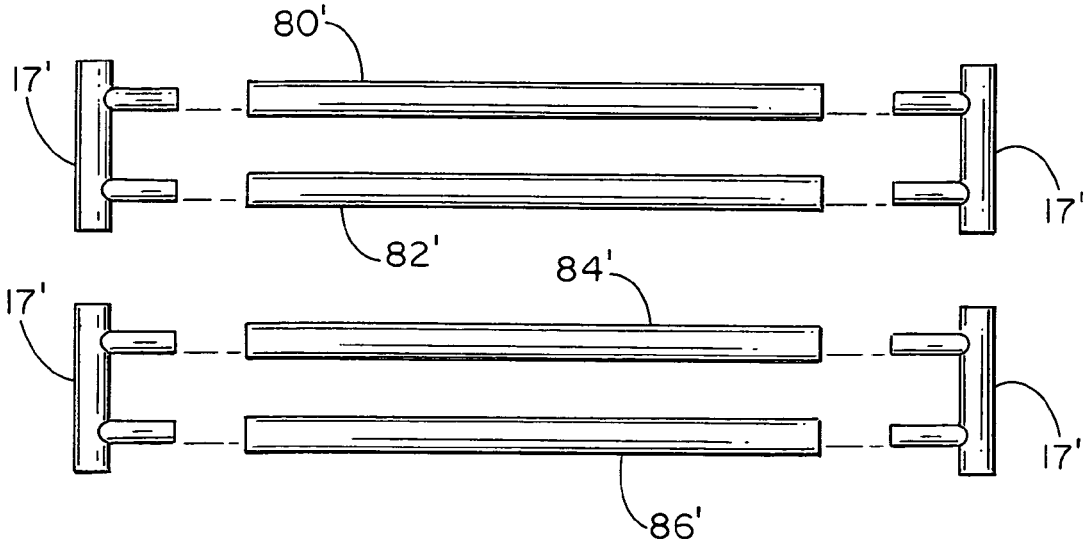
FIG. 2B is an exploded-parts view of an alternative embodiment of a dual socket member thereof.
Figure 3:
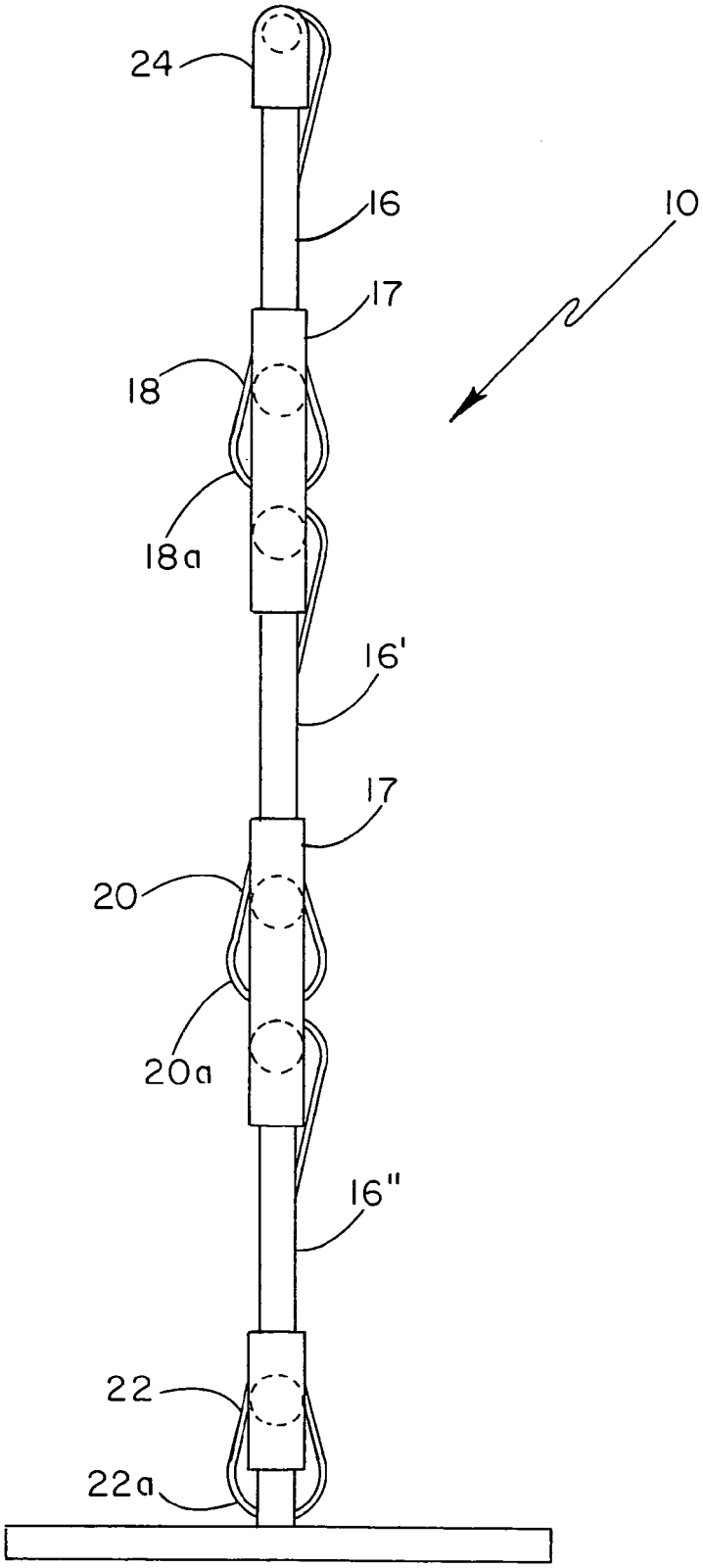
FIG. 3 is a side view of a target as in FIG. 1.

For the embodiment of the target members 10 that utilize the dual socket members 17' shown at FIG. 2B, the above description applies, except for the fact that four dual socket members 17' and four single crossbar members 80', 82', 84', 86' are used in lieu of the pair of dual crossbeam members 17 (shown in FIG. 2A).

Figure 2C:
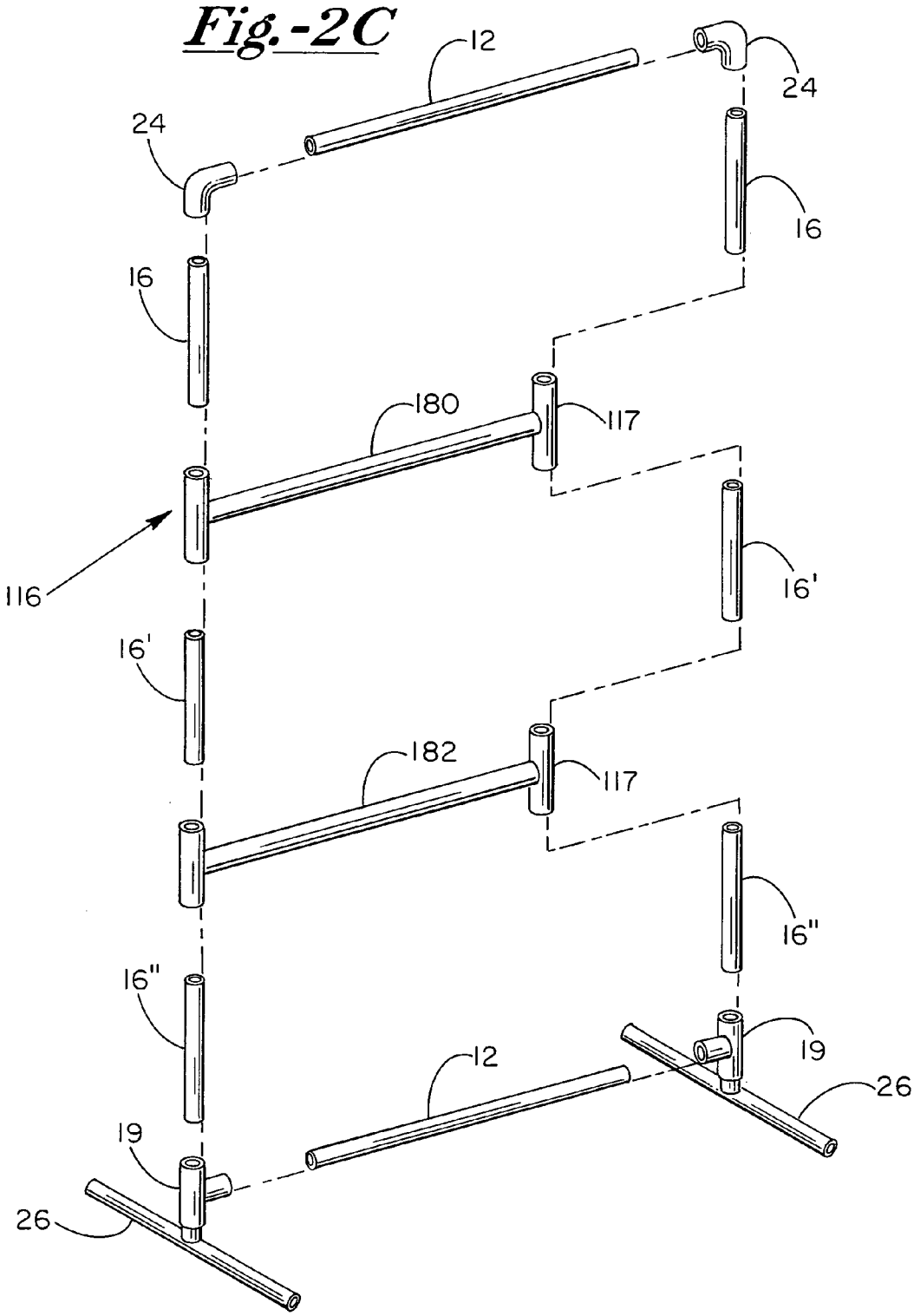
FIG. 2C is an exploded-parts view of an alternative upright target.
Figure 2D:
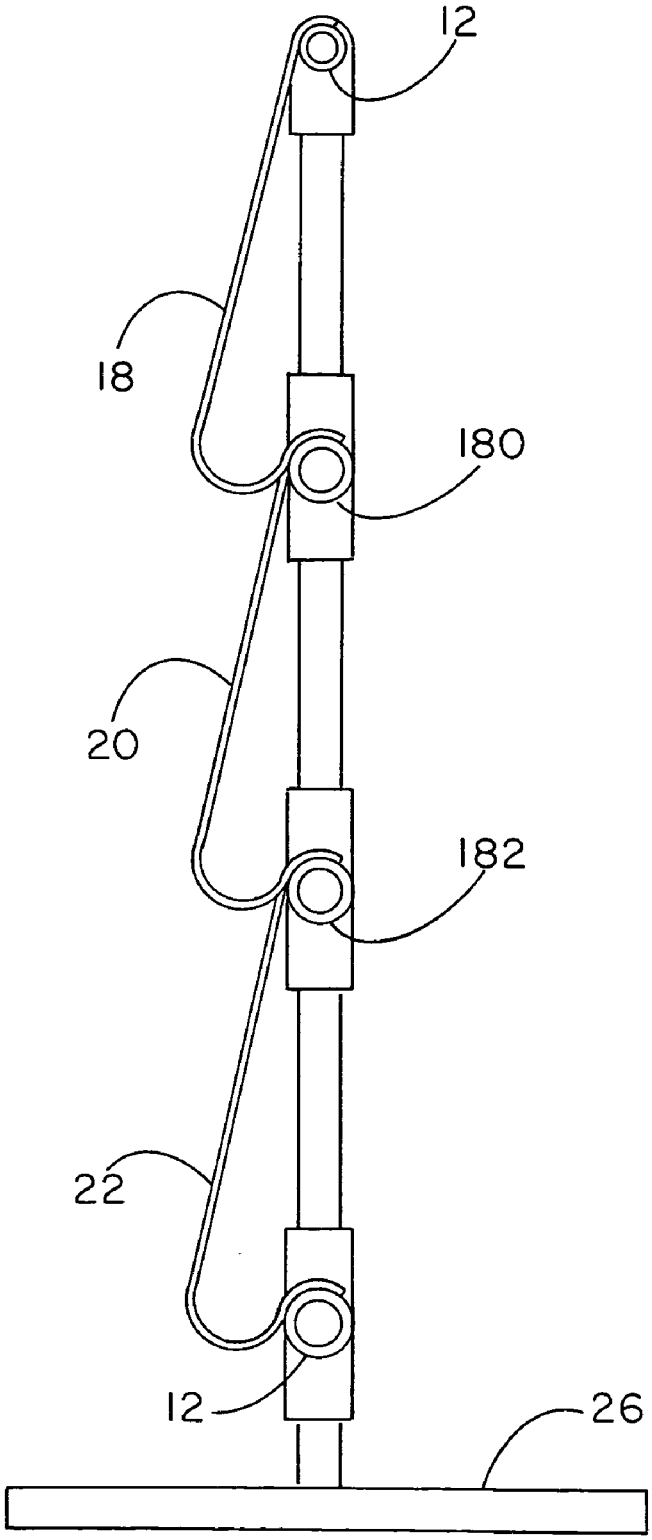
FIG. 2D illustrates a target zone arrangement used with the target of FIG. 2C.

FIG. 2C illustrates another alternative frame 116 for target member 10 similar to that shown in FIG. 2A, except that single crossbeam members 117 are used in lieu of dual crossbeam members 17. The upper crossbeam member 117 includes a single crossbeam 180, and the lower crossbeam member includes a single crossbeam 182. These single crossbeams accommodate an alternative target zone arrangement in which each of the lower target zones 20 and 22 is sewn or otherwise attached at its upper end to the target zone above it, as illustrated in FIG. 2D. If desired, strips of closure material or other means may be employed to releasably attach target zones 18–22.

Figure 9:
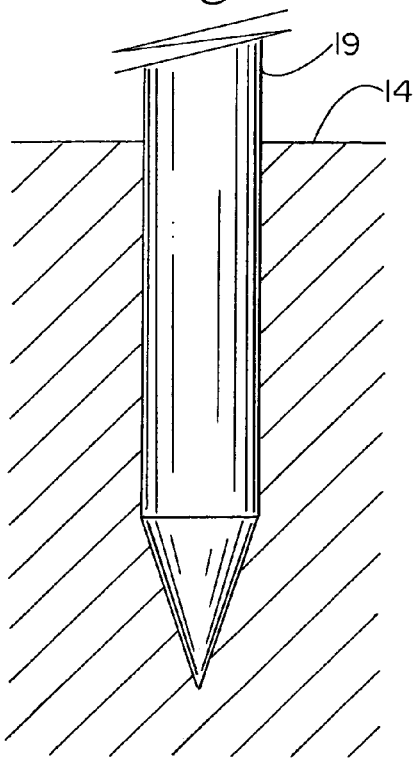
FIG. 9 is a side view depicting a base portion of the vertical support member adapted to be inserted into an outdoor playing surface.

Each of the frame components preferably comprises a flared outer end portion and an inner sleeve end portion joined in a male/female type coupling held together with friction. Other types of fittings may be used to couple the frame components together during play. In addition, alignment structures may also be used. Of course, if portability is not desirable the present invention may comprise a permanently assembled structure, or the projectile game may be set up for play on any suitable playing surface 14, such as outdoors on a grass, dirt or sand field or beach. In addition as depicted in FIG. 9, the base member 12 may be replaced with a tapered or sharpened portion of each coupling member 19 for piercing the playing surface 14 to provide stability to each target member 11.

The vertical support segments 16 and the coupling members 24,19 preferably comprise polyvinyl chloride (PVC) tubing color coordinated to match an adjacent target zone 18,20,22, but may comprise any other suitable tubing material such as aluminum, resin-based, extruded, molded or composite material(s) including metallic alloys and ceramic materials and the like.

While the target members 10 of the game of the present invention are preferably easily disassembled, as noted above same may be permanently assembled with use of suitable adhesives, solvents and the like. Also, while perhaps not suitable for disassembly and storage in a satchel like the preferred embodiments of the present invention, the game apparatus may be formed as a single compound structure or as a few integrated components.

A target member 10 used to play most forms of the game is readily assembled and disassembled with parts thereof preferably color-coded. In one embodiment, a pair of targets 10 is preferably disposed one facing the other in a spaced apart configuration. The distance the targets 10 are spaced apart is based on the magnitude of the gait, or stride, of one of the players (see FIG. 11); thus, the game is automatically adaptable to the size and age of the players. The preferred target spacing is about ten (10) paces of any given player.

Each team uses a different color set of gaming projectiles 30. The projectiles 30 may be closed bags filled with granular material (beanbags), irregular shaped members, sticks or batons. A pair of spheres coupled together with a cord may also serve as projectile 30. In a preferred embodiment, the projectiles 30 comprise sets of balls or spheres with each set having a common color. Each of the projectiles 30 preferably has a common size (e.g., diameter) and is fabricated of resilient material such as rubber, resin-based material or plastic. The spheres may be hollow or solid and may be painted or printed with indicia and/or a design (see FIG. 4) so that different sets of projectiles 30 are readily distinguishable from other of such sets. Two different colored projectiles 30 comprise a set with each set comprising three individual projectiles 30. Of course, more than two different colors (or patterns or other indicia) may be used if more players or teams are to use a common set of target members 10. Likewise, more than three projectile units may be provided for use by each team or player.

Figure 4:
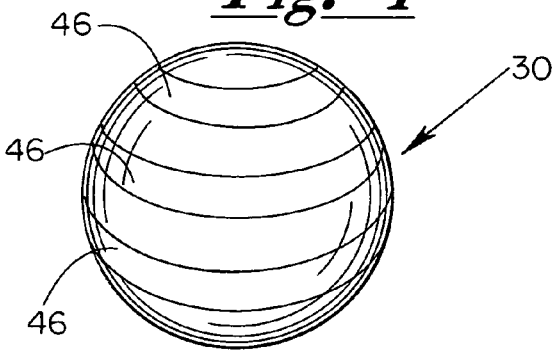
FIG. 4 depicts a spherical projectile having surface portions covered with optional indicia, which may comprise reflective and/or colored material.
Figure 7:
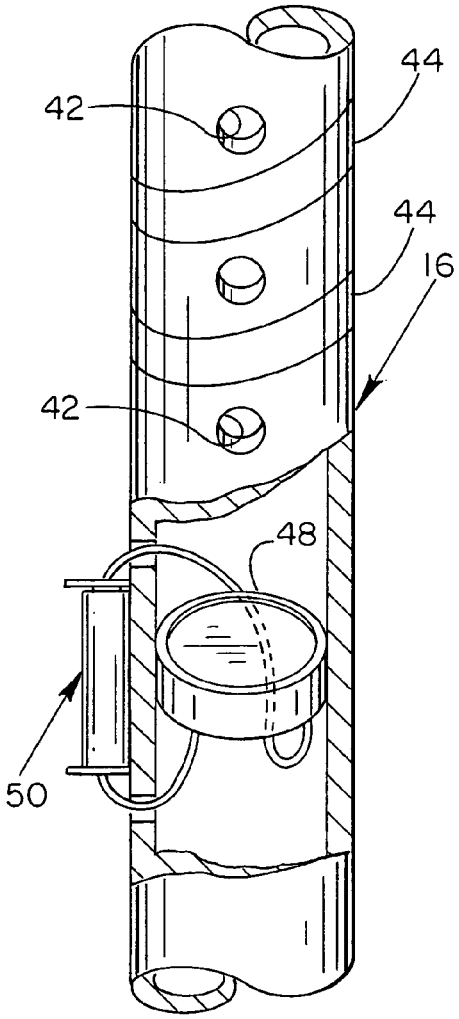
FIG. 7 depicts a portion of a vertical support member in an embodiment of the present invention having a series of apertures and indicia, the indicia comprising reflective and/or colored indicia covering a portion of the surface of the support member as well as an optional source of illumination (and power) for illuminating the support member.
Figure 8:
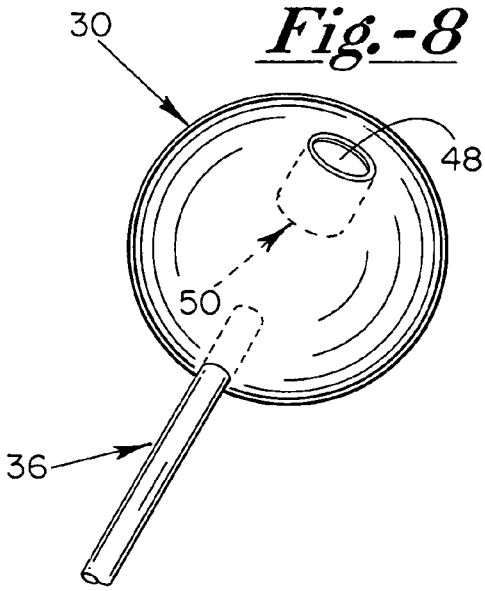
FIG. 8 depicts a portion of a spherical projectile in an embodiment of the present invention having an aperture for retaining an optional source of illumination (and power) for illuminating the sphere.

As depicted in FIG. 7, for nighttime performance of the game, portions of the target members 10 may be provided with reflective portions 44 and illuminated by a remote source of continuous (or stroboscopic) light or may be provided with one or more discrete (colored or white) sources of light 48 (including one or more LEDs) coupled to a source of power 50. Such a source of light 48 may be disposed within one or more of the elongated segments of a target member 10 and such elongate segment(s) provided with apertures 42 or fabricated with material that conducts light so that the players can see the target member 10 even if no additional illumination is provided. Similarly, as depicted in FIG. 4 and FIG. 8, one or more of the projectiles 30 may be provided with reflective portions 46 and illuminated and/or provided with an internal light (and source of power) 48/50 and fabricated of light conducting materials or having apertures formed in the surface thereof for such light to escape so that players can see the projectiles 30 in flight or elsewhere, including on the playing surface 14 both before and after each round of play.

In addition, the three target zones 18, 20, 22 are each preferably color-coded with a unique color. In one embodiment, the topmost target zone 18 is red, the middle target zone 20 is white and the bottom target zone 22 is blue. Similar color-coding can be used in the construction of the adjacent vertical support members 16 that couple the horizontal crossbar members 12,17. Such an embodiment may be changed to any arbitrary color scheme or the entire frame of the target 10 may be a single color.

The target zones 18,20,22 are each formed with a sheet of material such as fabric or netting and the like. Each sheet is preferably marked with a numeral indicating the number of points awarded for successfully lodging a projectile therein.

Each target zone preferably is sized to provide a consistent sized pouch when the target 10 is assembled, as shown in FIG. 3. Since each of the target zones have a slightly different sized surface area opening toward the front, each should be correspondingly sized (i.e., target zone 18 should be slightly shorter than target zone 20, etc.). With the top target zone having the smallest sized opening and the bottom target having the largest sized opening. So that the top and bottom target zones 18, 22 may be readily assembled and disassembled as desired, the sheet of material is constructed and arranged to be secured to a crossbeam. While an integral dual crossbeam member is preferred (and described in detail herein), a set of four individual straight crossbeam members 80', 82', 84', and 86' may be used in conjunction with four dual socket members 17'. Dual socket members 17' decrease the time and effort for initial manufacture of the targets 10, while dual crossbeam members 17 decrease component count and the likelihood of incorrect assembly.

The materials comprising the target zones 18,20,22 may be releasably secured to the respective crossbeam member with patches of hook and loop material (i.e., Velcro®), adhesive material, pins, buttons and the like. In an alternative embodiment, the sheet of material has loops sewn at the upper portion of the top target zone 18 and the lower portion of the bottom target zone 22. For integral dual crossbeam members 17, the middle target zone 20, the bottom portion of the top target zone 18 and the top portion of the bottom target zone 22 can be permanently coupled to the respective crossbeam of the dual crossbeam members 17. The length of the material used to construct the target zones is preferably sufficient to create a pouch disposed below a lower crossbeam member (as shown in FIG. 3). The pouch may be open-sided or may have a portion of material sewn or otherwise coupled to the lateral sides of the pouch. The spacing between adjacent crossbeam members may vary so to increase (or decrease) the chance of a projectile passing between adjacent crossbeam members and dislodging a projectile from a pouch. The sides of the target zone may be coupled to the adjacent vertical frame members, although such construction is not preferred.

For the dual socket member 17' of the alternate embodiment, four dual socket members 17' and four straight crossbeam members 12 are required. Also, the three target zones 18,20,22 are constructed with opposing channels, or loops of material, permitting the straight cross members to slide therethrough.

A method of assembling the target members 10 involves the following steps. Initially, (and for initial assembly only) a coating of petroleum-based lubricant is preferably applied to each of a plurality of compatible coupling members to promote ease of initial assembly (and later disassembly).

For the embodiments that utilize the dual crossbeam members 17, the middle target zone 20 attaches to one dual crossbeam member 17 at the lower crossbeam and the upper crossbeam of the second dual crossbeam member 17. As a result, the two dual crossbeam members 17 form a practical starting point for assembly of each of the target members 10. Accordingly, the upright portion of the members 10 can be assembled by connecting the two dual crossbeam members 17 together with a pair of intermediate length (or white color) straight frame members 16. These straight frame members 16 are readily identified by length and/or color.

For the embodiments that utilize dual socket members 17', the above described steps are replaced by the following steps. A pair of crossbar members, for example, 80' and 82' are inserted into the opposing channels of target zone 20, a crossbar member is inserted into the bottom channel of target 18, and a crossbar member is inserted into the top channel of target zone 22. The ends of the crossbar members are inserted into a corresponding socket of each of the dual socket members 17'. That is, the crossbar member coupled to the lower channel of target zone 18 is inserted into the upper socket of a first dual socket member 17' and the crossbar member coupled to the upper channel of target zone 22 is inserted into the lower socket of the second dual socket member 17'. A pair of intermediate (while color) straight frame members 16 are coupled between the dual socket members 17' that support target zone 20.

Then, for both embodiments described above, the proximal end of a pair of the shortest (red colored) straight frame members 16 are coupled to the upper crossbeam member (17 or 17'). A single crossbeam member 12 is threaded though the upper channel of the target zone 18 and at each end of the top single crossbeam member 12 a pair of L-shaped frame members 24 are attached. Then, the distal ends of the shortest (red color) straight frame members 16 are coupled to the L-shaped members 24.

The two longest (blue color) straight frame members 16 are inserted into the lower socket of each of the dual socket/crossbeam members (17' or 17). A single crossbeam member 12 is inserted through the lower channel of the target zone 22. Then, the ends of the single crossbeam member 12 are each inserted in the leg portion of a pair of T-shaped coupling members 19 and the longest (blue color) straight frame members 16 are inserted into the T-shaped coupling member 19. The remaining port of the T-shaped member coupling 19 either couples to the base portion of the target 26 or may have an optional stabilizing attachment coupled thereto (e.g. foot or block member 27 at FIG. 10).

Disassembly is a simple matter, involving the reverse of assembly steps recited hereinabove, with an additional step of optionally storing the disassembled apparatus in a storage bag or vessel 28, tightening a draw string 29 about an opening thereof (see FIG. 5A) or zipping the bag shut (see, FIG. 5B) and transporting and/or storing the disassembled projectile game.

Preferably and as mentioned, the target zones 18, 20, 22 are each colored, preferably, red, white and blue, respectively. The straight frame members 16 adjacent the top target zone 18 are preferably the shortest of the straight frame members and are colored red. The straight frame members 16 adjacent the middle target zone 20 have an intermediate length and are colored white. The straight frame members 16 adjacent the bottom target zone 22 are the longest of the straight frame members and are colored blue. The color of all other components is preferably white.

Figure 6A:
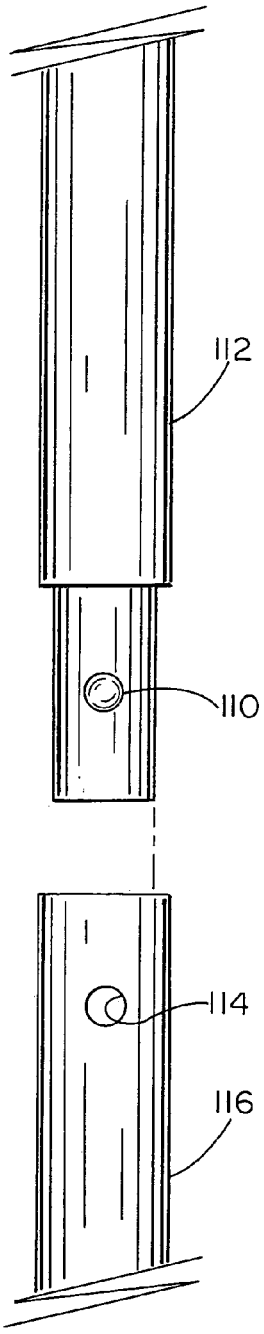
FIG. 6A, FIG. 6B and FIG. 6C depict attachment mechanisms for connecting separate components of the frame of the freestanding upright target.
Figure 6B:
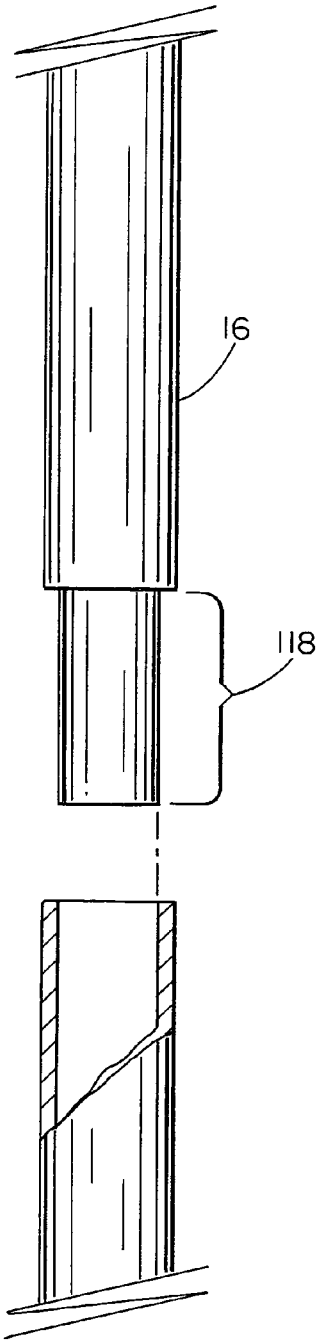
Figure 6C:
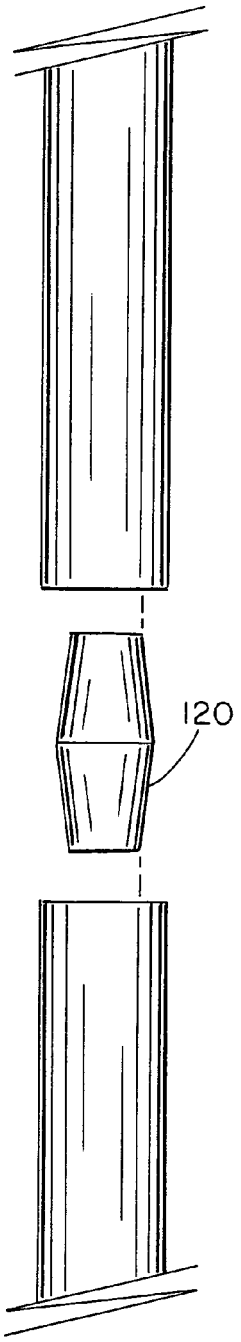

While coupling members having ports sized to receive the elongated segments of the target members in an essentially "friction-fit" type of sliding mechanical coupling (see FIG. 2A), the frame components of a target member 10 may be assembled and coupled together using a variety of coupling materials and methods. For example, as shown at FIG. 6A, a snap fit means or spring button 110 in a first member 112 may correspond to an opening 114 in a second member 116 to be attached thereto. Alternatively, as shown in FIG. 6B, elongated support members 16 may comprise segments 118 having a slightly narrower diameter at a first end and slightly wider at the other so that the narrower end of a first member slides into and is retained by friction in the wider portion of a second member. Such a friction fit may be used in conjunction with other fittings (especially for the crossbar members 12). The ends thereof may be color-coded, numbered, tabbed, wrapped or flagged with a bit of material to promote assembly. Alternatively, as shown at FIG. 6C, a separate fitting 120 may be used to hold a first and second member together. As noted and as depicted the base members 26 are especially adapted for indoor use and/or use where it is difficult to pierce the ground or other playing surface 14. While not depicted herein, other coupling mechanisms may also be utilized such as traditional threaded shank and threaded nut pairs (with locking-type of other washers), a set of clevis-type pin members coupled to cotter-type pin members, adhesive tape wrapped about adjacent ends of the elongate support members 16 (and the crossbar members 12), and combination thereof with the proviso that such coupling mechanisms are designed to, and are in fact capable of, withstand the impact of the bolo balls 30 during play and can capably connect the crossbar members 18,20,22 for extended periods of time without breakage or slippage and the like.

Figure 10:
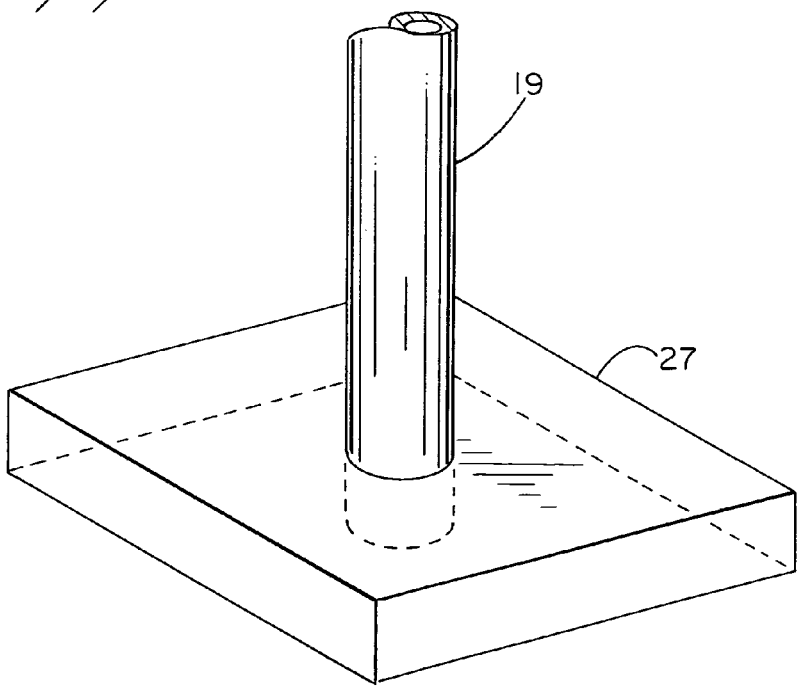
FIG. 10 is a perspective view of an alternate configuration of a vertical support member having a base member comprising a block of material into which the lower end of the vertical support member is inserted.
Figure 11:
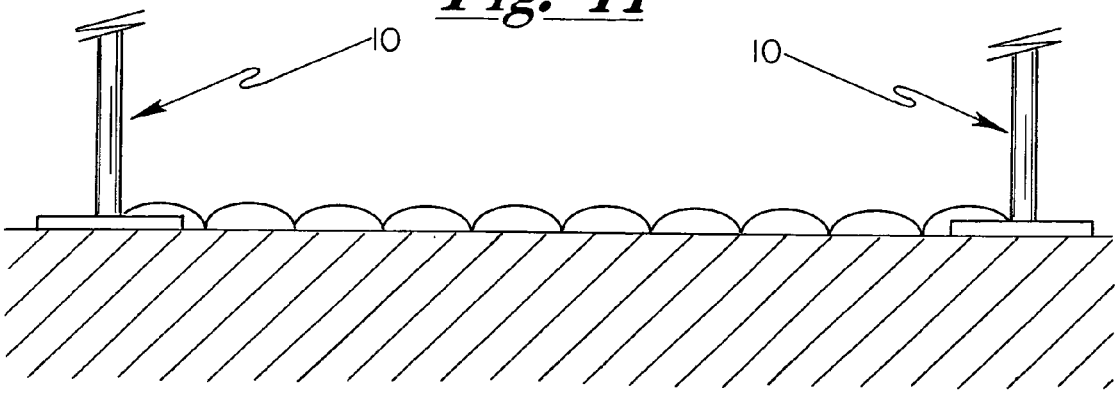
FIG. 11 illustrates the preferred placement of two freestanding upright target members configured for play of the projectile game, spaced apart ten paces as measured by a player's gait.

As depicted in FIG. 9 and FIG. 10, the base portion or member 12 may comprise tubular segments with pointed ends, or ballasted base members 27, each having a single vertically-oriented port sized to receive an elongate vertical support segment 16 of a target member 10. Such a weighted base member 27 may have additional ballast provided by filling an internal cavity or reservoir disposed in the base member. The ballast may comprise rocks, sand, water, bricks, dirt or any reasonably available dense material and the like. Such a base member 27 preferably has a major surface in contact with the playing surface 14 so that the "footprint" thereof is sufficient to resist any tipping action imparted to the target member 10 by the projectiles 30, the wind, occasional player contact and the like. While not depicted, a spring or elastic fitting may be disposed at or near the base member 27 to allow for the target 10 to absorb the impact of a projectile 30.

The target member 10 may be scaled in size as desired for an intended group of players. For example, a toddler version may be fabricated that is much smaller and perhaps less robust and/or lower cost than an adult version of the target member 10 or a "long distance" version may be fabricated for play wherein the projectiles are hurled much farther than the preferred ten (10) pace spacing between two multi-featured targets 10 (see FIG. 11).

Figure 5A:
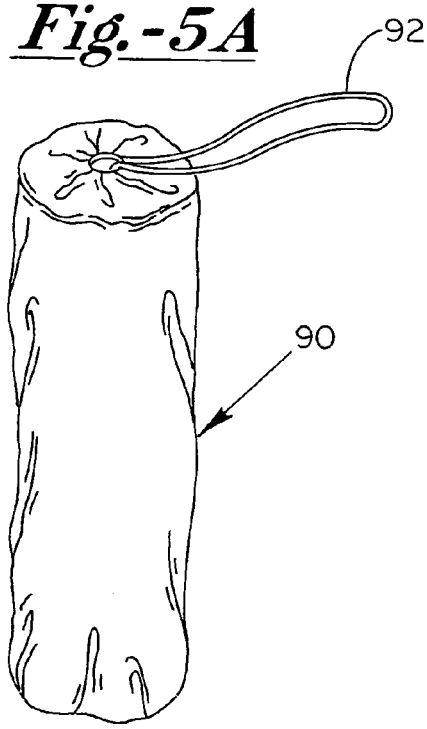
FIG. 5A and FIG. 5B depict optional carrying bags for transporting and/or storing the projectile game of the present invention.
Figure 5B:
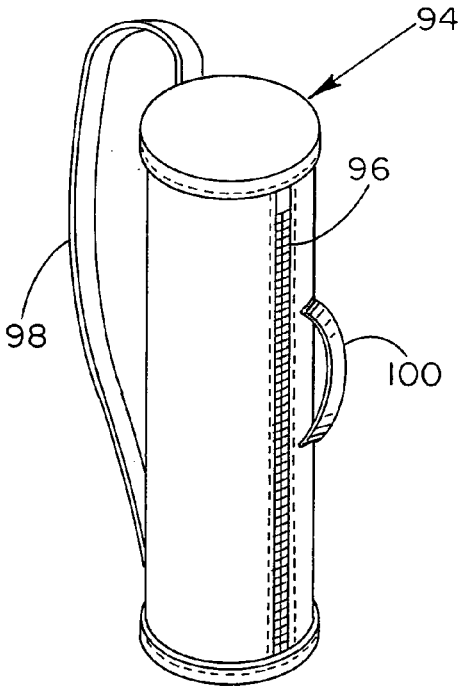

Referring to FIGS. 5A and 5B, the bag or satchel 90 or duffel bag 94 used to store and/or carry the bolo ball projectile game of the present invention may comprise a soft-sided fabric bag having an opening at one end with a means of closing the bag such as a drawstring 92 or zipper 96, hook and loop fastener patch materials, buttons, etc., to protect the components of the game from the elements, damage and/or loss. While not depicted herein, the bag or satchel may comprise a hard-bodied package, and in any event, the bag or satchel may have additional interior pockets or divider portions to help organize the individual components of the projectile game. Additional interior storage or other portions may optionally provide for a location to store clothing, directions for assembling and playing the projectile game, and miscellaneous items related or unrelated to the projectile game of the present invention.

To commence play, a player stands next to a target 10 and hurls a projectile 30 at an opposing target 10 with a goal of lodging the projectile 30 in a one of several target zones 18,20,22. In the illustrated embodiment, points are awarded based on which of three target zones 18,20,22 the projectile 30 lodges. In one form of the present invention, lodging a projectile in the topmost target zone 18 scores three points, in the middle target zone 20 scores two points, and the bottom target zone 22 scores one point, although other scoring schemes may be used.

During play, the first team to score exactly a pre-set number of points is declared the winner of each game. Preferably, the number of points to win a game is set at twenty-one. If a player exceeds the pre-set number of points they (and their team) must go back to their last score and the other player (or team) attempts to score and win the game. For each round of the game, all the projectiles 30 preferably remain in place until the round is over. If opposing players (or teams) lodge their respective projectiles in the same target zone in the same round, a "wash" is declared and no points awarded for that particular target zone (or zones if two target zones both have projectiles lodged by both teams). This scoring technique allows for blocking maneuvers between teams, which increases the competition and provides opportunities for advanced play.

As with the traditional game of "horseshoes," the players of one team preferably stand abreast one target and aim for an opposing target spaced from the first target. Play proceeds with both players (or teams) aiming for a common target 10, or if four players (or teams) are playing the game according to the present invention, pairs of players may aim for opposing targets or all four may aim for a common target 10.

In the course of performance of an individual game a timer or clocking means may be used to promote rapid play. Such timer or clocking means may comprise a hourglass, a digital clock, an analog clock, a periodic recorded (and replayed) musical note, a piece of recorded music, a recorded voice, an audible signal, a flashing light or strobe and the like.

Figure 12:
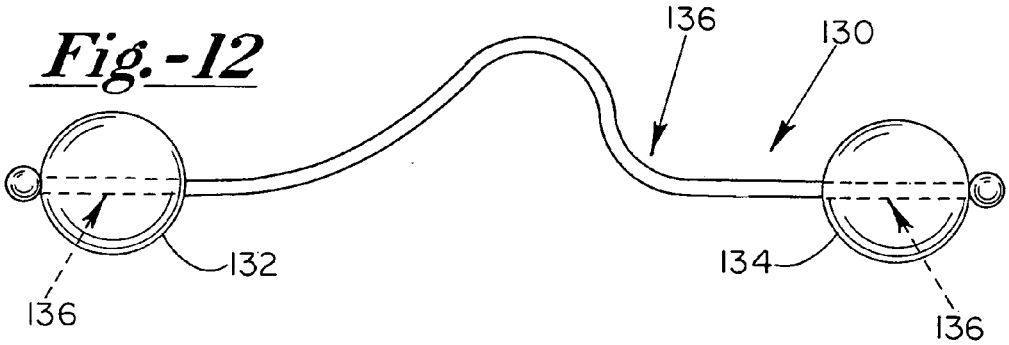
FIG. 12 depicts a bolo-style projectile for use in an alternative version of the game.

FIG. 12 illustrates an alternative, bolo-type projectile 130 in the form of two balls or spheres 132 and 134 connected by an elongate pliable coupling structure 136. The coupling structure preferably is a cord, although a variety of alternatives may be employed including a ribbon, string, rope, band, strap, length of twine or wire. In this version of the game, the preferred target is frame 116 shown in FIG. 2C. No target zone material is employed, and scoring is based on the ability to toss the projectile toward one of crossbeams 12, 180 and 182 in a manner leading to wrapping engagement of the projectile about the crossbeam. The cord or other structure should have a length at least three times the diameter of crossbeams (12, 180, 182), more preferably at least four times the diameter, to facilitate a wrapping of the projectile (by the cord) about one of the crossbeams when the flying projectile encounters it. Spheres 132 and 134 preferably are formed of a resilient material such as rubber or plastic. The spheres may be hollow or solid, braided with indicia as shown in FIG. 4 for a single sphere, or provided with an illumination source as shown in FIG. 8 for a single projectile 30 and having a cord 36. If desired, the cord may incorporate an illumination source.

Figure 13:
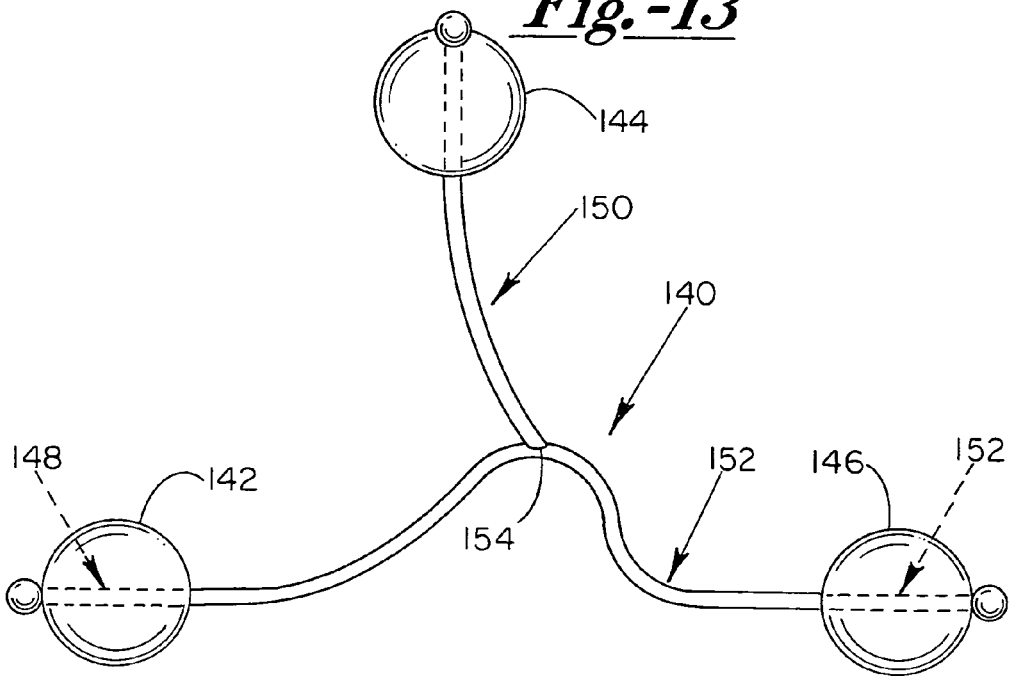
FIG. 13 illustrates a further alternative bolo-type projection.

FIG. 13 illustrates an alternative projectile 140 in which three spheres or balls 142, 144 and 146 are joined by a coupling structure including elongate cord sections 148, 150 and 152. One end of each cord section is coupled to its associated sphere, with the other ends of the cord sections coupled at a common junction 154. Again, scoring is accomplished by tossing projectile 140 to achieve a wrapping engagement of the projectile about one of the crossbeams.

Cord sections 148–152, and cord 136 of projectile 130, can be substantially inextensible. Alternatively, the cord and cord sections can be resilient, to allow an elastic stretching of the cord or cord sections as projectile 130 or 140 wraps about one of the crossbeams.

Additional advantages and modifications will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

What is claimed is:

1. A gaming apparatus, comprising:

an upright first target member disposed substantially perpendicular to the horizontal plane of a playing surface and having a set of target zones comprising a first target zone, a second target zone below and proximate the first target zone, and a third target zone below and proximate the second target zone;

said first target member including first and second substantially vertical support members, and a plurality of parallel and spaced apart crossbeam members coupled to said vertical support members;

at least one projectile adapted to be directed toward the first target member;

wherein the crossbeam members include a topmost first crossbeam member defining a top region of the first target zone, a second crossbeam member disposed below the first crossbeam member and defining a top region of the second target zone, and a third crossbeam member disposed below the second crossbeam member and defining a top region of the third target zone; and first, second, and third sheets of material, said sheets of material including respective first, second and third top portions supported proximate the first, second and third crossbeam members, respectively;

wherein the first and second crossbeam members are spaced apart by a first vertical distance, and the second and third crossbeam members are spaced apart by a second vertical distance different from the first vertical distance.

2. The gaming apparatus according to claim 1 further comprising an upright second target member substantially identical to the first target member, the second target member disposed substantially perpendicular to the horizontal plane of the playing surface and spaced from the first target member a distance of about ten paces of a player.

3. The gaming apparatus of claim 1 wherein:

each of said sheets is adapted to provide a pocket for capturing the at least one projectile.

4. The gaming apparatus according to claim 1 wherein each said sheet of material is constructed and arranged to be permanently secured around one of the crossbeam members.

5. The gaming apparatus according to claim 1 wherein each sheet of material has a numeral printed thereon.

6. The gaming apparatus according to claim 1, wherein each sheet of material is a different color.

7. The gaming apparatus according to claim 1 wherein:

at least two of the crossbeam members are part of a unitary structure including two upright end portions and the two crossbeam members.

8. The gaming apparatus according to claim 1 wherein at least two of the crossbeam members are part of a structure adapted to be disassembled, including two crossbeam members and two coupling members releasably coupled to the crossbeam members to maintain the crossbeams in a parallel relationship.

9. The gaming apparatus according to claim 1, further comprising reflective material disposed on a portion of the target member.

10. The gaming apparatus according to claim 1, further comprising a source of illumination disposed within a portion of the target member.

11. The gaming apparatus according to claim 1, wherein the first target member further comprises a base member coupled to each vertical support member.

12. The gaming apparatus according to claim 11 wherein the base member comprises an elongate extension member.

13. The gaming apparatus according to claim 11, wherein the base member has a hollow portion for receiving ballast material.

14. The gaming apparatus according to claim 1 wherein each of the vertical support members has an end tapered to facilitate insertion in the ground.

15. The gaming apparatus according to claim 1, wherein the vertical support members and crossbeam members are fabricated from a material selected from the group consisting of PVC tubing, aluminum tubing, steel tubing, metal tubing, composite tubing, ceramic tubing, resin-based tubing, plastic tubing or bamboo material.

16. The gaming apparatus according to claim 1 wherein each of the vertical support members comprises:

a plurality of segments; and a plurality of coupling members coupling the plurality of segments together.

17. A gaming apparatus, comprising:

an upright first target member disposed substantially perpendicular to the horizontal plane of a playing surface and having a set of target zones comprising a first target zone, a second target zone below and proximate the first target zone, and a third target zone below and proximate the second target zone;

said first target member including first and second substantially vertical support members, and a plurality of parallel and spaced apart crossbeam members coupled to said vertical support members; and at least one projectile adapted to be directed toward the first target member;

wherein the crossbeam members include a topmost first crossbeam member defining a top region of the first target zone, a second crossbeam member disposed below the first crossbeam member and defining a top region of the second target zone, and a third crossbeam member disposed below the second crossbeam member and defining a top region of the third target zone;

wherein the first and second crossbeam members are spaced apart by a first vertical distance, and the second and third crossbeam members are spaced apart by a second vertical distance different from the first vertical distance; and wherein at least two of the crossbeam members are part of a structure adapted to be disassembled, including two crossbeam members and two coupling members releasably coupled to the crossbeam members to maintain the crossbeam members in a parallel relationship.

18. The gaming apparatus of claim 17 further comprising:

first, second and third sheets of material, said sheets of material including respective first, second and third top portions supported proximate the first, second and third crossbeam members, respectively.

19. The gaming apparatus of claim 18 wherein:

each of said sheets is adapted to provide a pocket for capturing the at least one projectile.

20. The gaming apparatus according to claim 18 wherein:

each said sheet of material is constructed and arranged to be permanently secured around one of the crossbeam members.

21. The gaming apparatus of claim 18 wherein:

the second and third top portions of the sheets of material are coupled to the first and second sheets of material, respectively.

22. The gaming apparatus of claim 17 wherein:

said crossbeam members comprise a first pair of crossbeam members including the first crossbeam member, a second pair of crossbeam members including the second crossbeam member and disposed below the first pair, and a third pair of crossbeam members including the third crossbeam member and disposed below the second pair.

23. The gaming apparatus of claim 17 wherein:

the at least one projectile comprises a first body, a second body, and a pliable coupling structure connected to the first and second bodies, the coupling structure comprising an elongate portion extending between the bodies and having a length selected to facilitate a wrapping engagement of the projectile about one of the crossbeam members.

24. The gaming apparatus of claim 23 further including:

a third body, wherein the coupling structure comprises first, second and third cord sections coupled to one another at respective first ends thereof and having second ends coupled to the first, second and third bodies, respectively.

25. A gaming apparatus, comprising:

an upright first target member disposed substantially perpendicular to the horizontal plane of a playing surface and having a set of target zones comprising a first target zone, a second target zone below and proximate the first target zone, and a third target zone below and proximate the second target zone;

said first target member including first and second substantially vertical support members, and a plurality of parallel and spaced apart crossbeam members coupled to said vertical support members; and at least one projectile adapted to be directed toward the first target member;

wherein the crossbeam members include a topmost first crossbeam member defining a top region of the first target zone, a second crossbeam member disposed below the first crossbeam member and defining a top region of the second target zone, and a third crossbeam member disposed below the second crossbeam member and defining a top region of the third target zone;

wherein the first and second crossbeam members are spaced apart by a first vertical distance, and the second and third crossbeam members are spaced apart by a second vertical distance different from the first vertical distance; and wherein said crossbeam members comprise a first pair of crossbeam members including the first crossbeam member, a second pair of crossbeam members including the second crossbeam member and disposed below the first pair, and a third pair of crossbeam members including the third crossbeam member and disposed below the second pair.

26. The gaming apparatus of claim 25 further including:

an upright second target member substantially identical to the first target member, the second target member disposed substantially perpendicular to the horizontal plane of the playing surface and spaced apart from the first target member a distance of about ten paces of a player.

27. The gaming apparatus of claim 25 wherein:

at least two of the crossbeam members are part of a unitary structure including two upright end portions and the two crossbeam members.

28. The gaming apparatus of claim 25 wherein:

the first pair of crossbeam members are spaced apart by a third vertical distance, and the second pair of crossbeam members are spaced apart by a fourth vertical distance less than the third vertical distance.

29. The gaming apparatus of claim 25 further comprising three sheets of material, each sheet being coupled between an associated one of the pairs of crossbeam members.

30. The gaming apparatus of claim 25 wherein:

the at least one projectile comprises a first body, a second body, and a pliable coupling structure connected to the first and second bodies, the coupling structure comprising an elongate portion extending between the bodies and having a length selected to facilitate a wrapping engagement of the projectile about one of the crossbeam members.

31. The gaming apparatus of claim 30 wherein:

the bodies are spherical, and the coupling structure comprises a cord.

32. The gaming apparatus of claim 31 further including:

a third spherical body, wherein the coupling structure comprises first, second and third cord sections coupled to one another at respective first ends thereof and having second ends coupled to the first, second and third spherical bodies, respectively.

33. The gaming apparatus of claim 30 wherein:

the coupling structure is substantially inextensible.

34. The gaming apparatus of claim 30 wherein:

the length of the coupling structure is at least four times a diameter of the crossbeam members.

* * * * *